US006981496B2

(12) United States Patent
Szendrovari et al.

(10) Patent No.: US 6,981,496 B2
(45) Date of Patent: Jan. 3, 2006

(54) POINT CHISEL

(75) Inventors: Jozsef Szendrovari, Kecskemet (HU); Werner Britten, Landsberg (DE); Jozsef Varga, Kecskemet (HU)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/670,066

(22) Filed: Sep. 23, 2003

(65) Prior Publication Data

US 2004/0069292 A1 Apr. 15, 2004

(51) Int. Cl.
*B28D 1/26* (2006.01)

(52) U.S. Cl. ..... 125/41; 125/42; 125/40

(58) Field of Classification Search ..... 125/41, 125/40, 42, 43; 81/463, 180.1; 175/914, 175/414, 415; 408/230, 221, 225, 226; 173/109; 411/9; 606/84
See application file for complete search history.

(56) References Cited

U.S. PATENT DOCUMENTS

| | | | | |
|---|---|---|---|---|
| 991,830 | A * | 5/1911 | Clements | 175/414 |
| 1,532,468 | A * | 4/1925 | Bawden | 175/414 |
| 1,551,717 | A * | 9/1925 | Watson | 175/414 |
| 2,629,588 | A * | 2/1953 | Neamand | 299/100 |
| 4,508,181 | A * | 4/1985 | Jenne | 175/19 |
| 5,145,237 | A * | 9/1992 | Schulz et al. | 299/100 |

FOREIGN PATENT DOCUMENTS

| | | |
|---|---|---|
| DE | 9914522 | 10/2000 |
| EP | 0156788 | 10/1985 |

* cited by examiner

*Primary Examiner*—George Nguyen
(74) *Attorney, Agent, or Firm*—Abelman, Frayne & Schwab

(57) ABSTRACT

A point chisel for use with a power tool includes an elongate stem (1) having, at its power tool side a shank (2) for securing the chisel in the power tool and, at its workpiece side, a useful region (3) having its outer diameter (H) tapering toward its workpiece end and having a cross-section (5) formed as a concave polygon by a plurality of axial grooves (4) extending radially toward a core diameter (K) that likewise tapers toward the workpiece side end of the useful region (3).

11 Claims, 2 Drawing Sheets

I
II
III
IV
V
VI
A
B
C
H
K
S
A'
A''
1
2
3
3'
4
5

POINT CHISEL

BACKGROUND OF THE INVENTION

1. Field of the Invention

The present invention relates to a point chisel for use with a power tool, in particular, a percussion power tool for working, in particular, stone and concrete.

2. Description of the Prior Art

Point chisels of the type described above have an elongate stem the power tool side of which is formed as a shank which is received in a chuck of a percussion tool with a possibility of a limited axial displacement, and a useful region extending to its workpiece pointed end that ends with a shaving or chipping active tip. As a result of its use, the tip wears off resulting in shortening of the workpiece side pointed section of the useful region. This leads to the increase of the chipping, active cross-section of the chisel, and the chisel becomes dull. However, stem cross-sections in form of a concave polygon are characterized by self-sharpening which improves the chipping capacity.

European Publication EP-0156789 A1 discloses a point chisel which is driven by a percussion power tool and has an elongate stem provided, at its power tool side, with a shank and having an outer diameter convexly tapering toward its workpiece end, a cross-section formed as a concave polygon with two or four axial grooves, and with the useful region having a prismatic core.

German Publication DE-19914522 A1 discloses a point chisel the useful region of which has a prismatic core and the cross-section of which is formed as a concave polygon with six grooves. The concave polygon extends only radially outwardly over the prismatic core, so that he self-sharpening effect takes place essentially when the useful region becomes dull in the intermediate and final sections of the useful region. In the initial section of the useful region, only the prismatic core is active, without self-sharpening of the chisel.

Accordingly, an object of the present invention is a point chisel having a particular high chipping capacity in the initial operational region of the useful region.

SUMMARY OF THE INVENTION

This and other objects of the present invention, which will become apparent hereinafter, are achieved by providing a point chisel having an elongate stem having, at its power tool side, a shank for securing the chisel in the power tool and, at its workpiece side, a useful region having an outer diameter tapering toward the workpiece end and having a cross-section formed as a concave polygon by a plurality of axial grooves extending radially toward a core diameter that likewise tapers toward the workpiece side end of the useful region.

With the core diameter tapering, together with the outer diameter, toward the workpiece end of the useful region, the useful region has a cross-section of a concave polygon along its entire longitudinal extent, which results in a substantially constant self-sharpening action. This leads, in particular to a particularly high chipping capacity in the initial operational section of the useful region in which both the outer diameter and the core diameter taper toward the workpiece end of the useful region.

Advantageously, the outer diameter tapers convexly in the useful region. This insures that the chipping output is reduced with an increased use only slowly.

Advantageously, the cross-sectional surfaces in different locations along the stem remains similar in the useful region of the chisel. Thereby, the shape of the concave polygon is retained over the service life of the chisel, and the self-sharpening effect constantly contributes to the retaining of the chisel chipping capacity.

Advantageously, the useful region has a number of axial gross equal 2n where n is a natural number. With the even number of axial grooves, they can be easily produced by a conventional deformation process such as cold pressing.

Advantageously, there are provided four axial grooves offset relative to each other by 75° and 105° or 90°, which permits to provide a point chisel with an outer diameter in the range from 12 mm to 40 mm.

Alternatively, there can be provided eight axial grooves offset relative to each other by 30° and 55° or by 45°, which permits to provide a point chisel with an outer diameter in the range from 35 mm to 50 mm.

Advantageously, the cross-sectional surface is reduced over 40–60% of the useful region toward the workpiece end by from 80% to 70%, which increases a shock drag toward the workpiece end and thereby the impact pulse force.

Advantageously, the outer diameter of the useful region, including the axial grooves, is larger than the stem diameter in the remaining portion of the stem. This provides for a minimal change of the stem cross-section in the transitional region.

Advantageously, the stem cross-section does not change along he transitional region, which provides for a very small rebounding of the impact pulse.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figures 1, 1A, 1B, 1C, 1D, 1E, 1F:
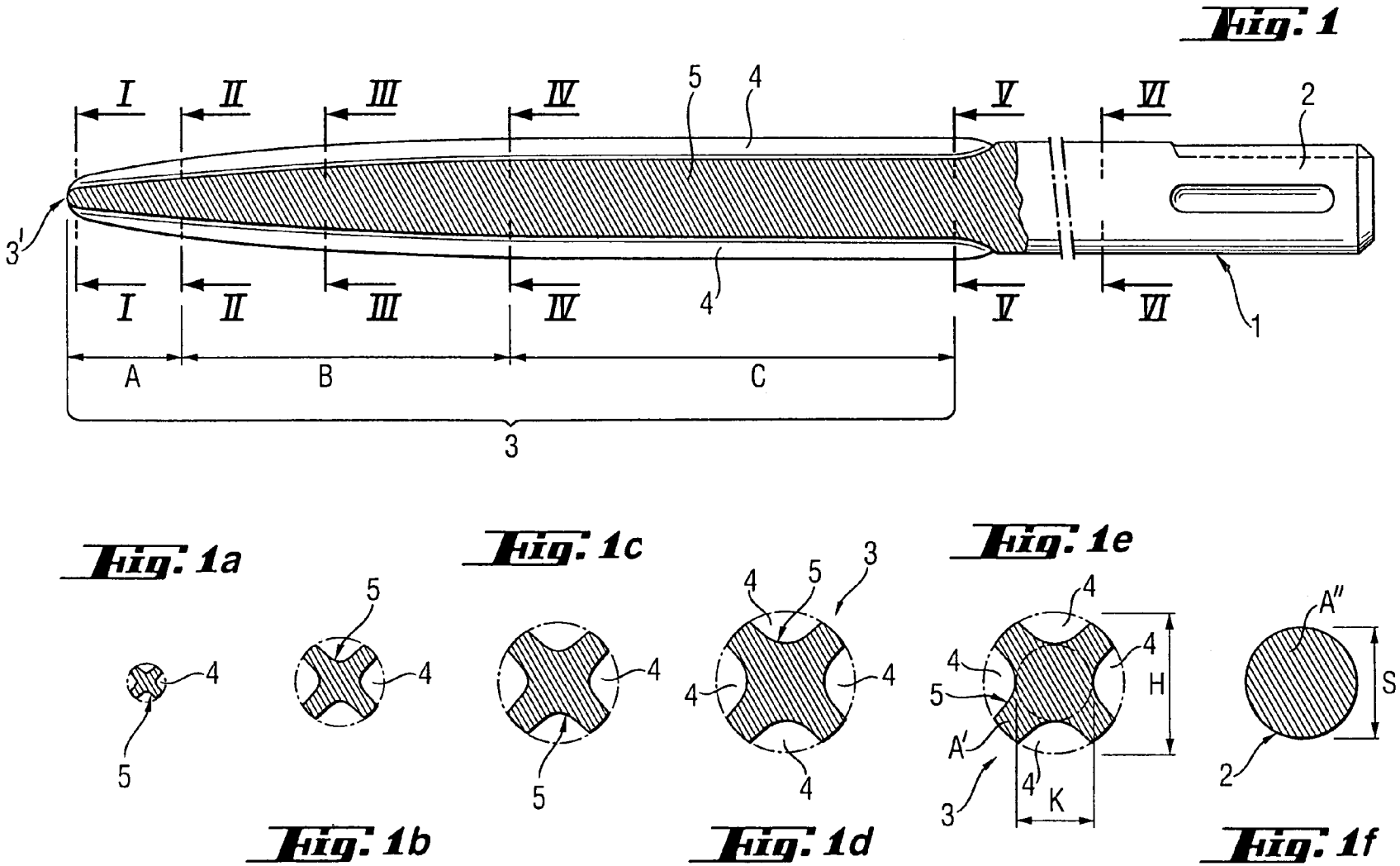
FIG. 1 a cross-sectional view of a point chisel according to the present invention.
FIG. 1*a*–1*f* a cross-sectional view of the chisel shown in FIG. 1 in different location of the stem.

A point chisel according to the present invention, which is shown in the drawings and, in particular, in FIG. 1, has an elongate stem 1 provided at its power tool side with a shank 2 and at its workpiece side with a useful region 3 formed an initial operational section A, an intermediate operational section B, and a final operational section C. A chipping tip 3' is provided at a free end of the initial operational section A. With an outer diameter H convexly tapering to the workpiece side end of the chisel, there are provided four axial grooves 4 offset with respect to each other by 90°. The groove flanks steeply and radially extend toward a core diameter K and form a cross-section 5 in form of a polygon. The core diameter K also tapers toward the workpiece side of the chisel, with the diameter K diminishing in the operational region 3 from 50% to 75%, which results in tapering of the cross-section 5, with similar cross-sections in positions I, II, III, IV, and V. The outer diameter H of the useful region 3 with the axial grooves 4 is greater than the diameter S of the shank 2. The cross-sectional surfaces A' and A" in the transitional region between the operational region 3 an the shank 2 remain the same.

Figure 2:
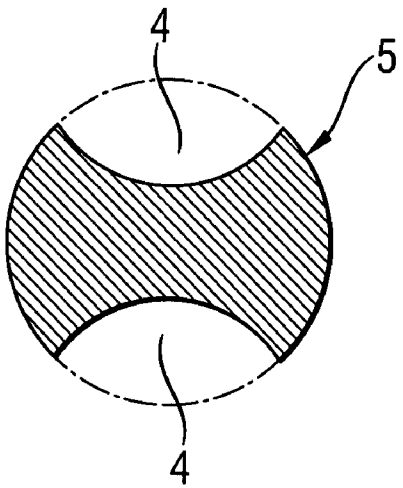
FIG. 2 a cross-sectional view of another embodiment of a point chisel according to the present invention.

FIG. 2 shows another embodiment of the inventive point chisel in which only two axial grooves 4, which are offset with respect to each other by 180°, are provided.

Figure 3:
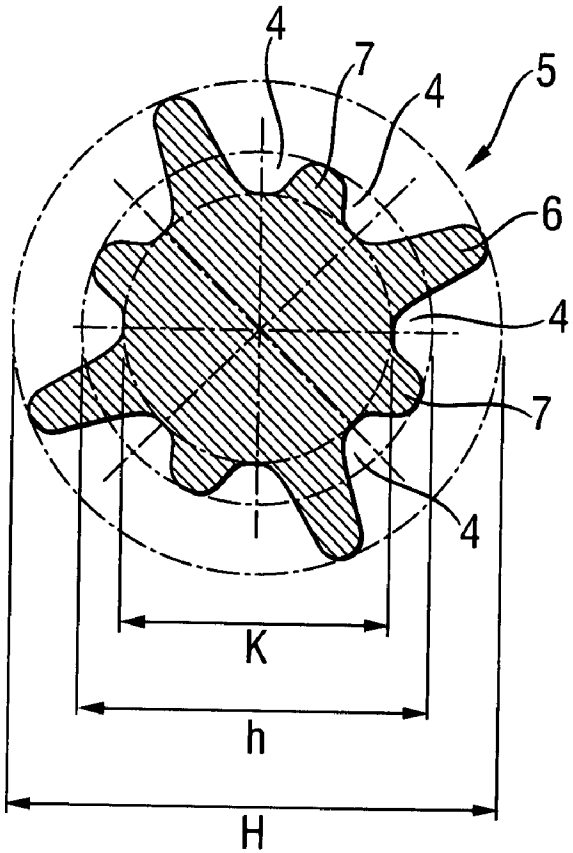
FIG. 3 a cross-sectional of yet another embodiment of a point chisel according to the present invention.

The inventive point chisel, which is shown in FIG. 3, has eight axial grooves 4 alternatively offset with respect to each other by angles of 30° and 55° and defining therebetween alternating webs 6 and intermediate webs 7 with an outer diameter H and a radially smaller outer diameter h, respectively.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed:

1. A point chisel for use with a power tool, comprising a power tool side formed as a shank (2) for securing the chisel to the power tool; and a workpiece side adjoining the power tool side and forming working region having a cross-section inscribed in a circle (3) being provided at a workpiece end thereof with a chipping tip (3') and having a core along an entire longitudinal extent thereof, the working region (3) having an outer diameter (H) tapering along a substantially entire axial extent thereof toward the workpiece end thereof and having a cross-section (5) formed as a concave polygon by a plurality of axial grooves (4) extending axially over substantially the entire longitudinal extent of the working region and up to the chipping tip (3') and radially toward the core of the working region, wherein a core diameter (K) likewise tapers toward the workpiece end of the working region (3) along a substantially entire axial extent of the core, whereby cross-sectional surfaces of the cross-section (5) of the working region are similar in different cross-sectional locations (I, II, III, IV, V) of the working region.

2. A point chisel according to claim 1, wherein the entire working region (3) convexly tapers toward the workpiece end thereof.

3. A point chisel according to claim 1, wherein the useful region (3) has a number of axial grooves equal to 2n where n is a natural number.

4. A point chisel according to claim 3, wherein the working region (3) has four axial grooves (4).

5. A point chisel according to claim 4, wherein the axial grooves (4) are offset relative to each other by an angle between 75° and 105°.

6. A point chisel according to claim 3, wherein the axial grooves (4) are offset relative to each other by an angle of 90°.

7. A point chisel according to claim 3, wherein the working region (3) has eight axial grooves (4).

8. A point chisel according to claim 7, wherein the eight axial grooves (4) are offset relative to each other by an angle between 30° and 55°.

9. A point chisel according to claim 1, wherein the cross-sectional surface (A') is reduced over 40–60% of the working region (3), from a power tool end to the workpiece end by from 80% to 70%.

10. A point chisel according to claim 1, wherein the outer diameter (H) of he working region (3), together with the axial grooves (4) is greater than a diameter (5) of a remaining portion of the stem (1).

11. A point chisel according to claim 1, wherein a cross-sectional surface (A', A") remains same in the transitional region between the useful region (3) of the shank (2).

* * * * *